US005126002A

United States Patent [19]

Iwata et al.

[11] Patent Number: 5,126,002

[45] Date of Patent: Jun. 30, 1992

[54] LEAF PAPER BUNDLING APPARATUS

[75] Inventors: Tsutomu Iwata; Tohru Akamatsu; Osamu Itoh; Makoto Miyagawa, all of Himeji, Japan

[73] Assignee: Glory Kogyo Kabushiki Kaisha, Hyogo, Japan

[21] Appl. No.: 587,835

[22] Filed: Sep. 25, 1990

[30] Foreign Application Priority Data

Sep. 29, 1989 [JP] Japan ..... 1-114357

[51] Int. Cl.[5] ..... B07C 5/00

[52] U.S. Cl. ..... 156/468; 156/475; 209/534; 53/582; 53/585; 53/586; 53/588; 53/590

[58] Field of Search ..... 156/212, 213, 216, 468, 156/475; 53/397, 436, 438, 441, 582, 585, 586, 501, 588, 590; 209/534

[56] References Cited

U.S. PATENT DOCUMENTS

| | | | |
|---|---|---|---|
| 3,994,118 | 10/1976 | Felix | 156/446 |
| 4,111,116 | 9/1978 | Ito et al. | 53/586 |
| 4,406,728 | 9/1983 | Ohba et al. | 156/475 |
| 4,499,709 | 2/1985 | Miyano et al. | 53/589 |
| 4,825,378 | 4/1989 | Yuge | 53/501 |
| 4,957,587 | 9/1990 | Rauch | 53/582 |

FOREIGN PATENT DOCUMENTS 109723 5/1987 Japan .

*Primary Examiner*—W. Gary Jones
*Assistant Examiner*—David Reifsnyder
*Attorney, Agent, or Firm*—Wenderoth, Lind & Ponack

[57] ABSTRACT

A leaf paper bundling apparatus winds a tape around the periphery of a stack of leaf papers. A stacking device stacks and aligns a predetermined number of leaf papers in an upright position in a direction parallel to the short edges of the leaf papers. Left and right holding fingers are employed to hold the stacked leaf papers and transfer the stacked leaf papers to a bundling position, maintaining the upright position of the stacked leaf papers. A tape fed by a tape supply is wound around the stacked leaf papers by a tape winding device. The tape is tightened about the stacked leaf papers, and a pair of clamping members clamp the stacked leaf papers therebetween. The clamping members each have spaced contact edges straddling the tape. The stacked leaf papers can then be tightly held together without interfering with the winding of the tape about the stacked leaf papers. Further, the contact edges of the clamping members are longer than the width of the stacked leaf papers so that the edges extend beyond the edges of the stacked leaf papers. This prevents the tape being tightened about the stacked leaf papers from bending the edges of the leaf papers. The tape is then cut by a cutting device, and the ends of the tape are bonded with a thermal bonding pad that is moved between the contact edges of one of the clamping members.

13 Claims, 15 Drawing Sheets

LEAF PAPER BUNDLING APPARATUS

BACKGROUND OF THE INVENTION

The present invention relates to a leaf paper bundling apparatus that winds tape around the outside of the paper that is held in a bundling position, cuts the tape and uses thermal bonding to bundle the leaf paper.

Conventional leaf paper bundling apparatus, as disclosed in Japanese Patent Laid-Open Publication No. 109723/1987, stacks leaf paper that is to be bundled at a stacking portion, conveys the stacked leaf paper to a bundling portion by conveyor means when the number of leaves has reached a certain number (in the case of banknotes, this number is customarily 100 of the same denomination), holds the stack between holders at the bundling portion, introduces a divider between the leaf paper held in the holder so that removing the divider winds the tape around the leaves and the holder when the ends of tape are held between the leaves, and bonds the cut end portions of the tape after they have been cut to complete the bundling operation. The bundled leaf paper is then pushed out from the space between the holders.

In addition, a different type of leaf paper bundling apparatus only performs bundling, and in this type, for example, an operator creates a stack of 100 notes of the same denomination and introduces them by hand into a bundling portion of a leaf paper bundling apparatus so that a portion other than the portion that is being held by hand is supported by a holder, a divider is inserted in between the leaves of this portion of the stack, tape ends are placed inside the stack so that removing the divider holds the tape ends between the leaves, and winds the tape around the holder as well. The tape is cut, and the cut end portions of the tape are bonded to complete the bundling operation.

However, in the former of these two types of conventional apparatus, the tape is wound around both the holder and the leaf paper that it holds, and so it is necessary to use a pusher to push the end portion of the bundle in order to expel it from the holder. There is a first problem in that the end portion that is pressed may be marked by the pusher. In addition to this, there is the additional problem with both the former and the latter apparatus in that it is easy for the neat bundle to become uneven when the bundle is removed from the holder, and this greatly deteriorates the appearance of the bundled paper.

A third problem exists in that, when the leaf paper is bundled by the tape, the leading edge of the tape in the direction in which it is wound turns down the leaves when the tape is wound, and this further deteriorates the appearance of the bundle.

A first objective of the present invention is to solve the first and second problems by the provision of a leaf paper bundling apparatus that bundles leaf paper by winding tape directly around the leaf paper and that does not slacken the tape during bundling.

A second objective of the present invention is to solve the first, second and third problems by winding tape directly around the leaf paper and by not allowing the leaf paper be turned down even when the tape is wound during bundling.

SUMMARY OF THE INVENTION

The present invention that solves the first and second of the problems described above for the conventional technology is a leaf paper bundling apparatus that winds tape around a periphery of a stack of leaf paper at a portion other than that which is held by the bundling apparatus. A clamping means, after the tape is wound, tightens in the vicinity of a tape winding portion of the leaf paper. A tape tightening means applies tension to the tape. The clamping means has first and second clamping members that contact the top and bottom leaves of the leaf bundle that is to be bundled, and clamps. Each of the clamping members has a pair of contact edges that are positioned on either side across the width of the banknotes at the portion where the tape is wound, so that when the leaf paper is clamped by the first and second clamping members, a tape thermal bonding pad is inserted in between the contact edges of one of the clamping members.

The second embodiment of the present invention that solves the first, second and third problems described above for the conventional technology is a leaf paper bundling apparatus in which left and right contact edges of first and second clamping members contact the top and bottom leaves of a stack of leaf paper at a portion other than that which is held by the bundling apparatus. The stack of leaf paper is compressed and held between these contact edges of the first and second clamping members and a tension is applied to the tape as soon as it has been wound. When the tape is cut, or immediately prior to or after the tape has been cut, a thermal bonding pad is inserted between the contact edges of one of the clamping members to thermally bond the tape so that releasing the clamping of the stack of leaf paper allows the prompt removal of the bundled paper.

In addition, in the first and second embodiments, in addition to the action described above, the length of the pair of contact edges provided to each of the first and second clamping members is such that it is longer than the width of the banknotes in the direction of the winding around the leaf paper stack, so that the entire width of the portion around which the tape is wound is compressed. The tape which has been wound around the stack of leaf paper, and to which a tension has been applied, thus does not bend the edges of the leaf paper towards the inside, and a neat bundle is formed.

A preferred embodiment of the present invention will become understood from the following detailed description referring to the accompanying drawings.

DESCRIPTION OF THE PREFERRED EMBODIMENTS

Figure 1:
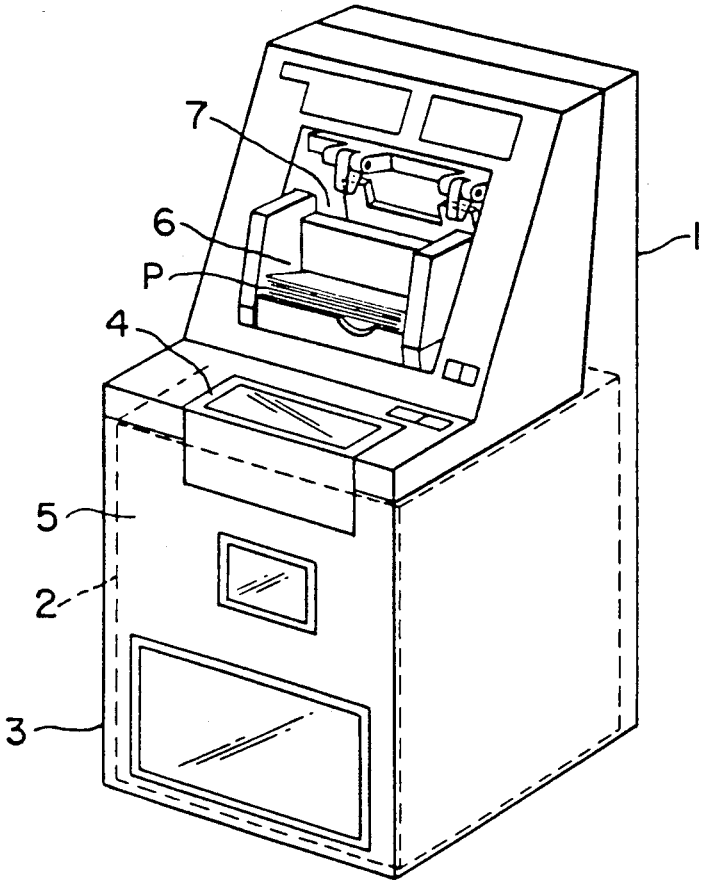
FIG. 1 is an external view of one embodiment of a bundling apparatus to which a bundling device according to the present invention has been applied.

The following is a detailed description of an embodiment according to the present invention, with reference to the appended drawings.

In this embodiment, the description will be given for the case where the leaf paper to be bundled is banknotes, with FIG. 1 being an external view of a banknote identification, counting and bundling apparatus 1 (hereinafter called as "the banknote bundling apparatus") into which a bundling device according to the present invention has been applied, and FIG. 2 being a diagrammatic view of the internal layout thereof. In FIG. 2, the left side is the front of the banknote bundling apparatus 1, and a bundling device 2 is incorporated into a machine frame 3, with this machine frame 3 being arranged so that it can be pulled out from the front of the banknote bundling apparatus 1. The front portion and the top portion at the front of the banknote bundling apparatus 1 has doors 4, 5 that can be freely opened to allow maintenance and inspection of the inside of the bundling device 2.

Toward the front and at the top of the banknote bundling apparatus 1 is a hopper 6 into which are loaded banknotes P that are to be bundled and a reject portion 7 for the return to a position immediately thereinabove of banknotes that are not suitable for bundling (because they are of different denominations, counterfeit, or damaged).

Figure 2:
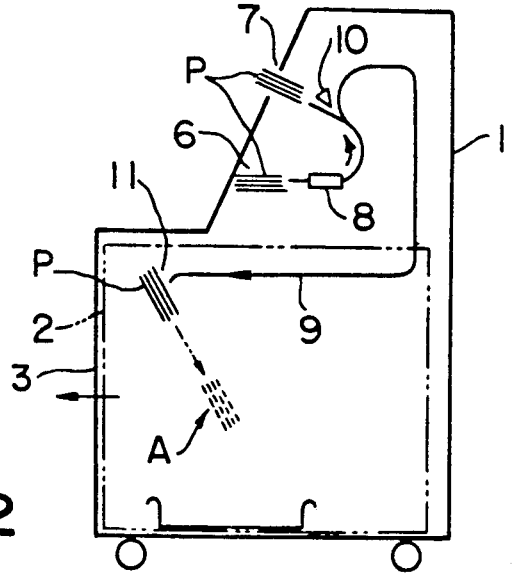
FIG. 2 is an outline sectional view of the internal layout of the bundling apparatus.

As is shown in FIG. 1, inside the banknote bundling apparatus 1 is a conveyor path 9 that has an identification portion 8 that uses a transfer means (not indicated in the figure) to identify each of the banknotes P that have been placed in the hopper 6, and separation fingers 10 and a separation portion of this conveyor path 9 so that banknotes that can be bundled are sent to a stacking portion 11 and banknotes that cannot be bundled are sent to the reject portion 7.

Figure 3:
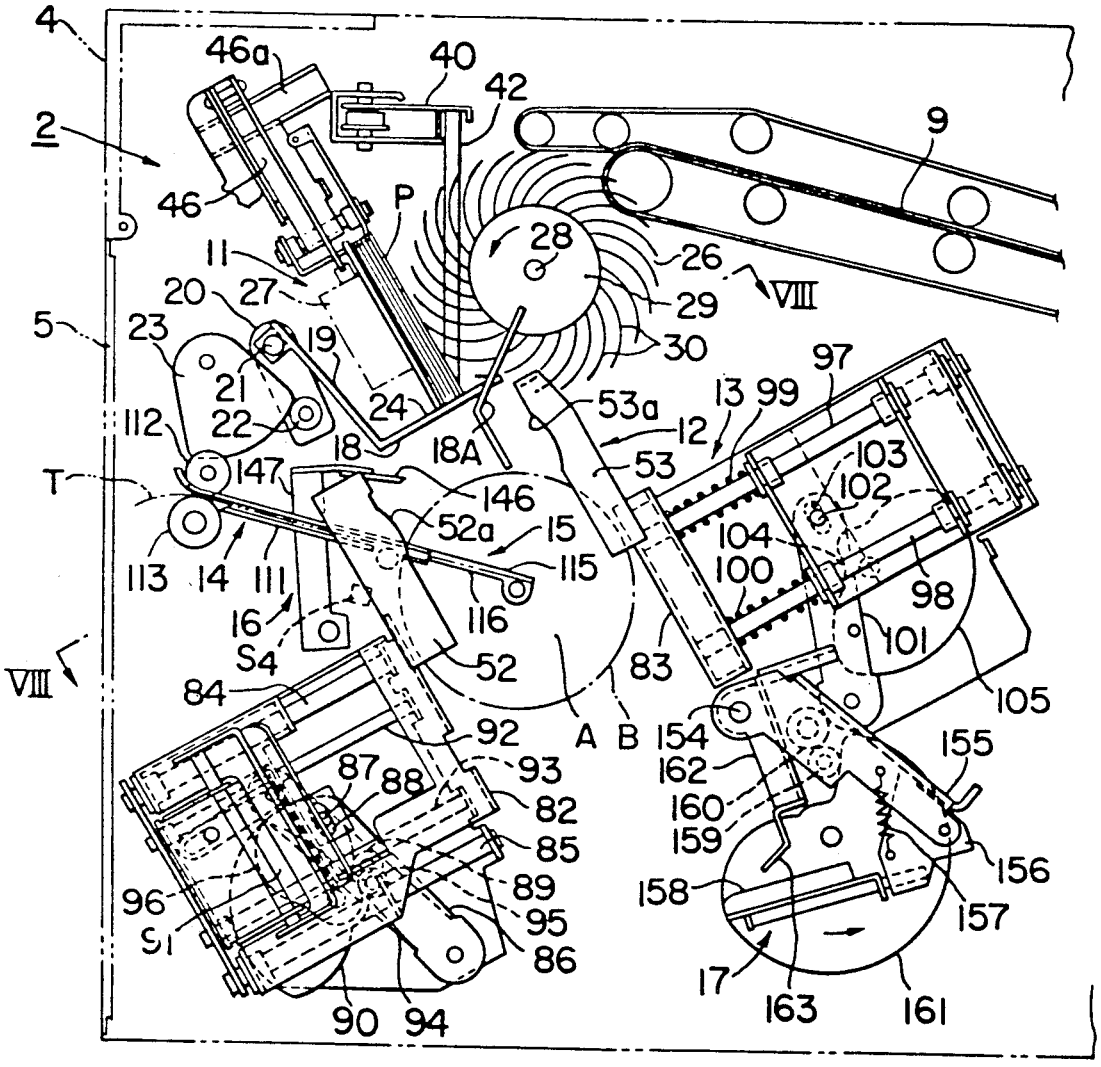
FIG. 3 is a sectional view that indicate a first embodiment of the bundling device according to the present invention.

As shown in FIG. 3, the bundling device 2 is provided with the stacking portion 11, which aligns both the long and short edges of the banknotes that are sent via the conveyor path 9 and which collates and stacks a predetermined number of banknotes, holding and transfer means 12 that holds and transfers the collated and stacked banknote in that stat from the stacking portion 11 to a bundling position A immediately below, clamping means 13 that clamps and holds the banknotes from both sides at a position that is separate from the position where the banknotes are held for transfer to the bundling position A, a supply means 14 that supplies a tape T for bundling, tape winding means 15 that winds the tape around the banknotes, a cutter mechanism 16 that cuts the tape T after it has been wound and tension applied thereto, and a thermal bonding pad 17 that heats and adheres the cut ends of the tape T.

The stacking portion Il has a receiving portion 18 which is roughly L-shaped in elevation. An upper potion of an upright portion 19 of the receiving portion 18 is mounted to a shaft 21 at one end of a rocker lever 20. A cam follower 22 at the other end of this rocker lever 20 contacts a cam 23, and the rotation of the cam 23 is transferred to rock the rocker lever 20. An outside end edge of a bottom portion 24 of the receiving portion 18 is formed with a plurality of cutouts 25,25,,, (indicated in FIG. 6). Peripheral portions of vane wheels 26,26,,, provided at the end of the conveyor path 9 enter into these cutouts 25,25,,, so that the banknotes P that are sent from the end of the conveyor path 9 are received one at a time by these vane wheels 26,26,,,. The rotation of the vane wheels 26,26,,, in the direction indicated by the arrow in FIG. 3 and FIG. 6 causes the banknotes P to remain on the bottom portion 24. Also, the bottom portion 24 is provided with a presser plate 27 that gradually advances and retreats in accordance with the quantity of stacked banknotes P that are sent to the bottom portion 24 by the vane wheels 26,26,,,. The presser plate 27 is supported by a link mechanism (not indicated in the figure), so that spring action always urges the stacked banknotes P at a constant force and in the direction of the vane wheels 26,26,,,. Moreover, the vane wheels 26,26,,, used here are known and have a plural number of vanes 30,30,,, curved in the same direction and embedded in the outer surface of a boss portion 29 fixed to a shaft 28, so that banknotes are received one at a time between the vanes and are carried to the side of the stacking portion 11. In addition, 18A is a guide plate for when the banknotes P are moved to the bundling position A. The guide plate 18A has a comb shape and prevents the entry of the holding fingers into the holding and transfer means 12 to be described later.

At one end of the stacking portion 11 is provided a fixed wall 31 that is the reference for aligning the long edges of the banknotes that are collated and stacked on the bottom portion 24 of the receiving portion 18. At the side at the other end is provided a long side alignment mechanism 32 that presses the edges of the stacked banknotes P in the direction of the fixed wall 31 and aligns them.

Figure 5:
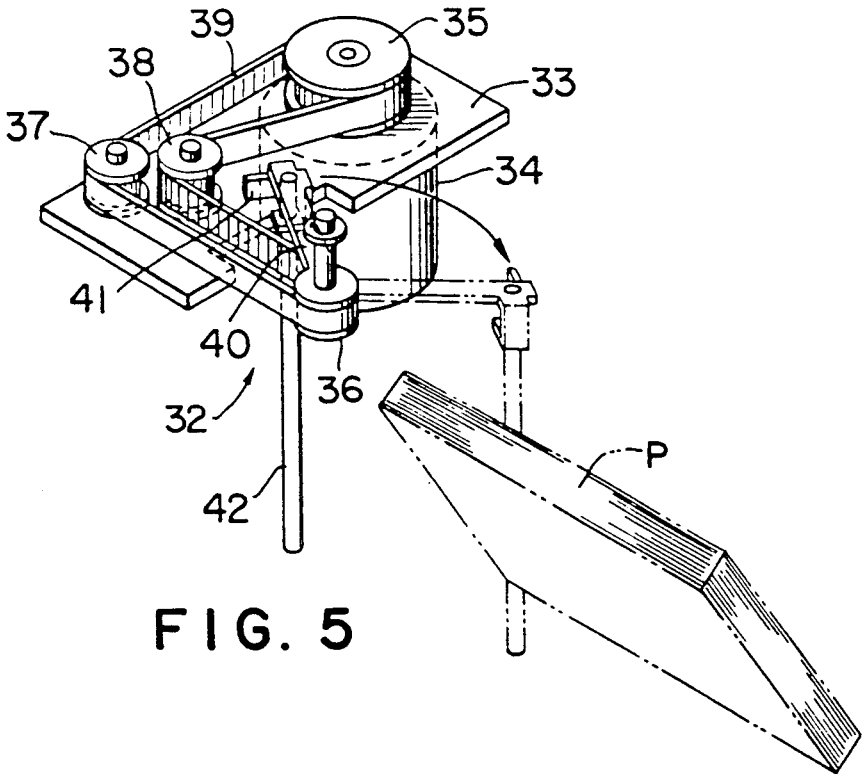
FIG. 5 is a perspective view of a direction alignment mechanism.

As indicated in perspective view in FIG. 5, this long side alignment mechanism 32 has a belt 39 wound around a pulley 35 on a shaft (not shown) of a forward-/reverse drive motor 34 fixed to a machine base 33. A pulley 36 is axially supported on the machine base 33, and has intermediate pulleys 37, 38 so that a forward-/reverse rotation is applied within a predetermined angular range to the pulley 36. An arm 40 is horizontally fixed to the pulley 36, and to a distal end of the arm 40 is provided an upright, round aligning rod 42 via a bracket 41. Accordingly, the arm 40 swivels from the position indicated by the solid line in FIG. 5 to the position indicated by the dotted line, so that the round aligning rod 42 comes into contact with one end portion in the direction of the long side of the banknotes P on the receiving portion 18 and presses the banknote P towards the side of the fixed wall 31, and the banknotes P are aligned using the fixed wall 31 as a reference. Moreover, the angle of rotation of the drive motor 34 is selected so that changing the swivel angle of the round aligning rod 42 enables it to correspond to banknotes P of different lengths. In addition, the alignment operation with the round aligning rod 42 is intermittently carried out so that there is one operation for each 10-20 banknotes P that are sent to the receiving portion 18.

Figure 6:
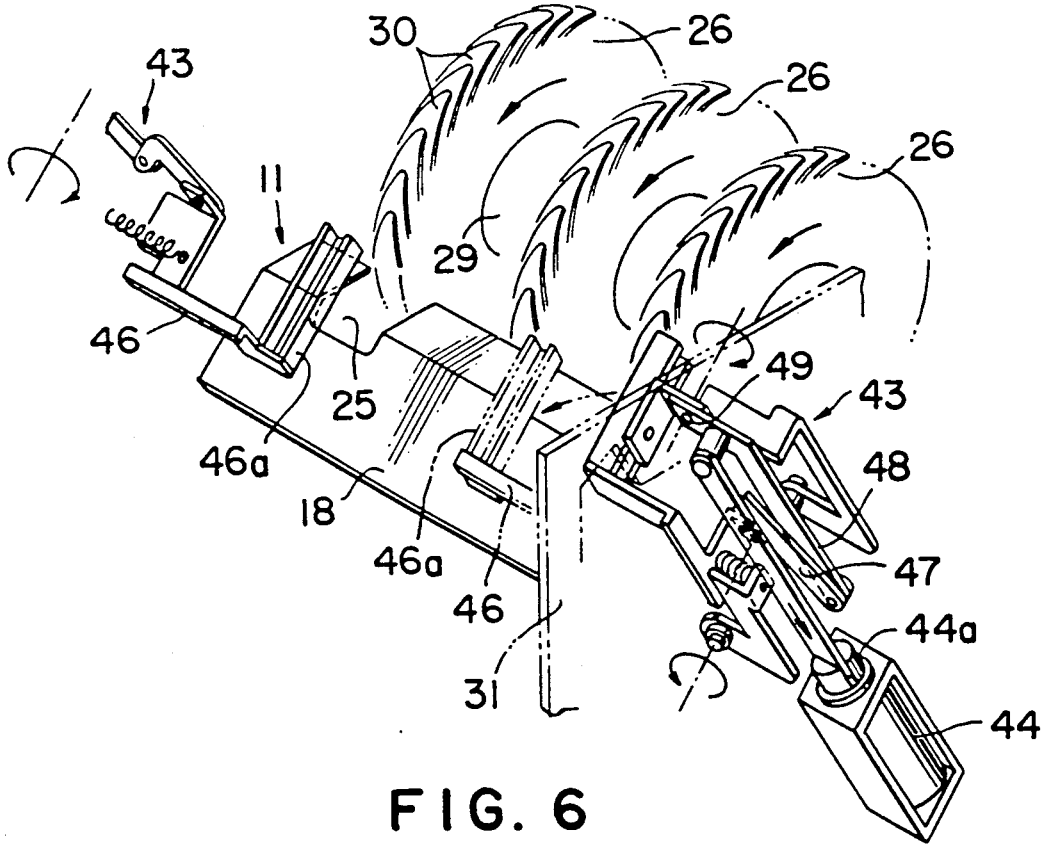
FIG. 6 is a perspective view of a leaf paper short direction alignment mechanism.
Figure 7:
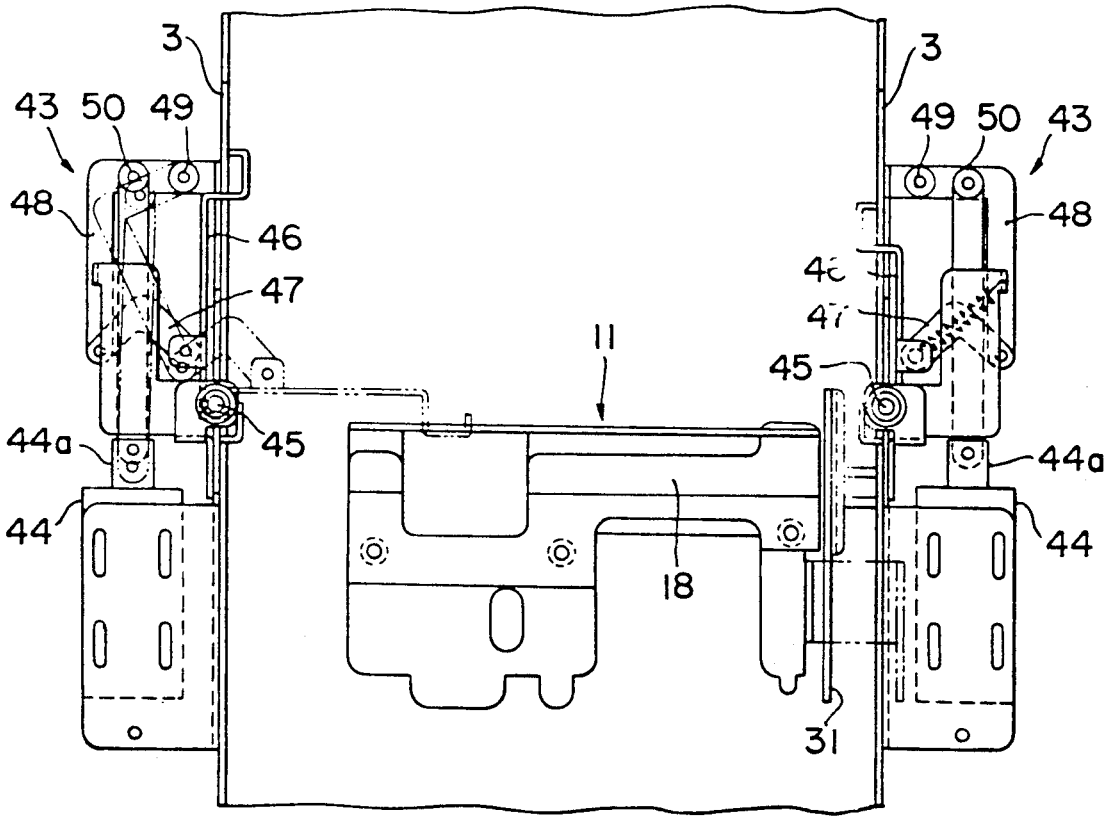
FIG. 7 is a plan view of the leaf paper short-direction alignment mechanism of FIG. 6.

As shown in FIG. 6, both sides of the stacking portion 11 are provided with short-direction alignment mechanisms 43,43 that align the upper ends of the banknotes P that are stacked and aligned in the receiving portion 18. These short-direction alignment mechanisms 43,43 are provided symmetrically left and right as indicated in the plan view of FIG. 7 and in the perspective view of FIG. 6, but for the sake of convenience, the description will be only for one side (the left side), with corresponding numerals used for corresponding portions on the other side.

The configuration of the short-direction alignment mechanism 43 comprises a solenoid 44 fixed to an outer surface of the machine frame 3, an alignment member 46 for which a base end is supported by a shaft 45 and which freely swivels in the direction of the stacking portion 11, a lever 47 having a "=" shape and to which one end is linked to the rear side near the base end of the alignment member 56, and a lever 48, one end of which is supported by the machine frame 3 and the other end of which is linked to the other end of the lever 47. A plunger 44*a* of the solenoid 44 is linked to a pin 50 of a pivot 49 of the lever 48 so that when the plunger 44*a* is contracted, as indicated by the dotted line in FIG. 7, the alignment member 46 swivels from the top portion on the side of the receiving portion 18 to the lower portion. An alignment portion 46*a*, that is, the distal end of the alignment member 46 bent at right angles, taps the upper ends of the banknotes P that are collated and stacked on the stacking portion 11. These short-direction alignment mechanisms 43,43 are intermittently driven in the same manner.

Figure 8:
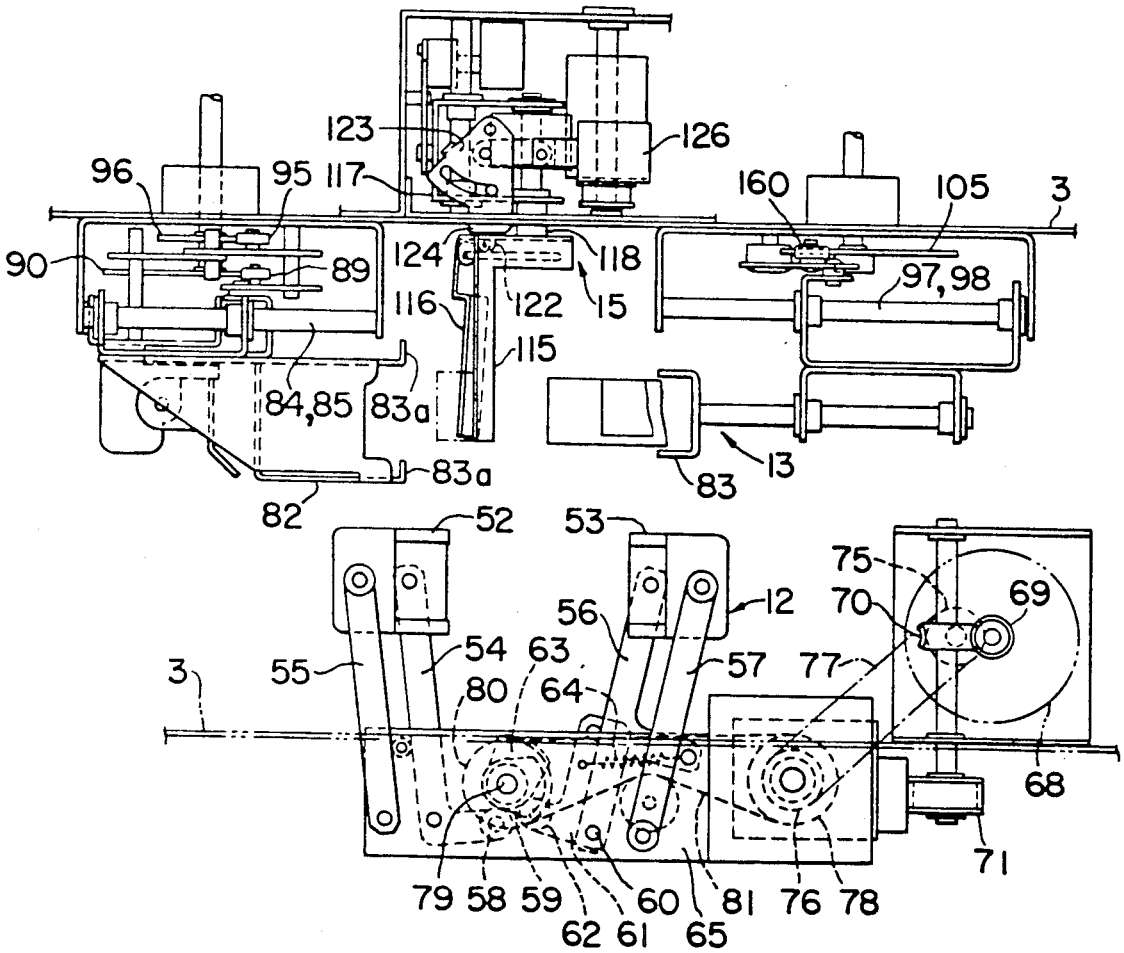
FIG. 8 is a perspective along the line VIII—VIII of FIG. 3.

The holding and transfer means 12 has left and right holding fingers 52,53 positioned on either side of the bundling position A and located at positions a certain distance between the short ends and the centers of the banknotes P. As indicated in the plan view of FIG. 8, and the elevational view in FIG. 9, the holding fingers 52,53 each have ends of two parallel arms 54,55 and 56,57 respectively pivoted to their base portions. The other ends of the parallel arms 54,55 and 56,57 are either directly or indirectly pivoted on the side of the banknote bundling apparatus 1 so that they configure a parallel link mechanism in which each of the holding fingers 52,53 can maintain a mutually parallel status while advancing and retreating. In FIG. 8, a cam follower 58 is pivotally mounted to the base end curved portion of one of the arms (54) of one of the holding fingers (52) on one side (the left side) and a spring (not indicated in the figure) brings it into contact with the surface of a cam 59 pivotally supported on the machine frame 3. The base end of one of the arms (56) of the holding finger (56) of the other side (the right side) is linked to an auxiliary lever 61 supported by a pivot 60 to the machine frame 3, and a cam follower 62 pivotally mounted to the base curved portion of the auxiliary lever 61 is urged by a spring 64 to contact the surface of a cam 63 on the same shaft as the cam 59. Accordingly, because of the action of the spring 64 when the holding finger 52 comes into contact with the banknotes P, it is possible to correspond to banknotes P of different thicknesses.

Figure 9:
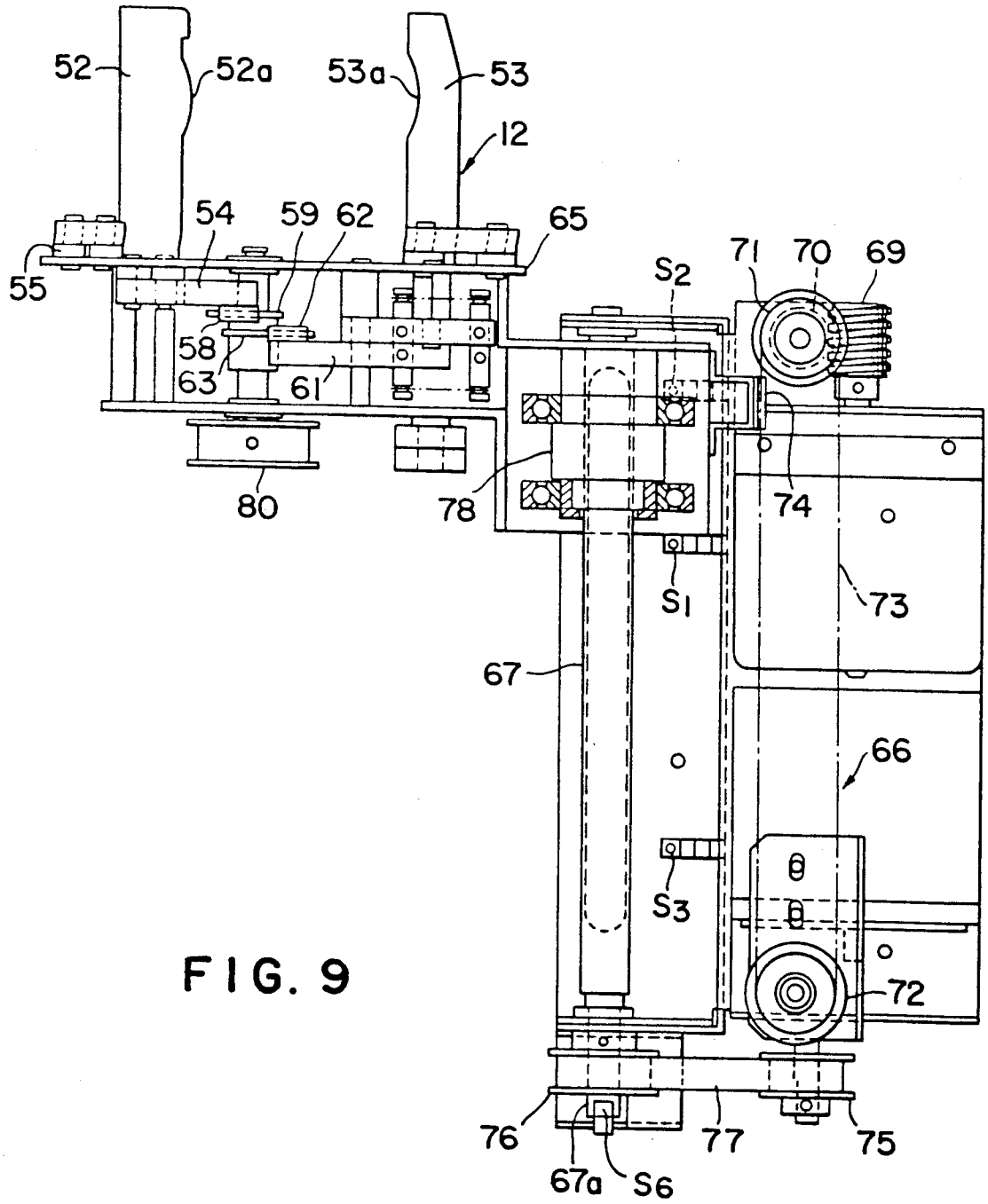
FIG. 9 is an elevational view of a holding and transfer means.

One of the holding surfaces of the holding fingers 52,53 has, as shown in FIG. 9, a protrusion surface 52*a* on which there are circular protrusions, and the other of the holding surfaces of the holding fingers 52,53 has a recess surface 53*a* on which there are circular recesses corresponding to the circular protrusions in the protrusion surface 52*a*, so that when banknotes P are held between the holding fingers 52,53, they bend along its long direction and do not slip even when they are held from one side only.

A lift mechanism 66 of a machine base 65 that supports these holding fingers 52,53, as indicated in FIG. 9, is supported by a shaft 67 having a non-circular cross section and which has its upper and lower ends supported by the machine base 65 so that it cannot rotate. A pulley 71 is rotated by a motor 68 on the machine frame 3 via a worm gear 69 and a worm wheel 70, and a belt 73 is wound around the pulley 71 and a pulley 72 pivotally supported towards the bottom of the machine frame 3. The belt 73 and the machine base 65 are linked by a linking member 74 so that the rotational movement of the belt 73 raises and lowers the machine base 65.

A belt 77 is wound around a pulley 75 that rotates by the rotation of the motor 68, and a pulley 76 is on the shaft 67. A belt 81 is wound around another pulley 78 on the shaft 67 and a pulley 80 on a shaft 79 of the cams 59 and 63 mentioned above, so that it applies a rotational motion to these cams so that the cam shape of these cams 59,63 moves the holding fingers 52,53 in the direction whereby they come together, and in the direction whereby they return to the position indicated in FIG. 8.

In addition, as shown in FIG. 9, toward the bottom of the shaft 67 are provided a detector plate 67*a* and a detection sensor $S_6$ in order to detect the rotational position of the shaft 67, and these detect the holding position and the opening position of the holding fingers 52,53.

The machine frame 3 is provided with sensors $S_1$, $S_2$ and $S_3$ that detect the position of the machine base 65. Sensor $S_1$ detects the standby position (the position indicated in FIG. 3), the sensor $S_2$ detects the position where the stacking portion 11 holds the banknotes P and the sensor $S_3$ detects the position where the movement to the bundling position A stops.

Figure 4:
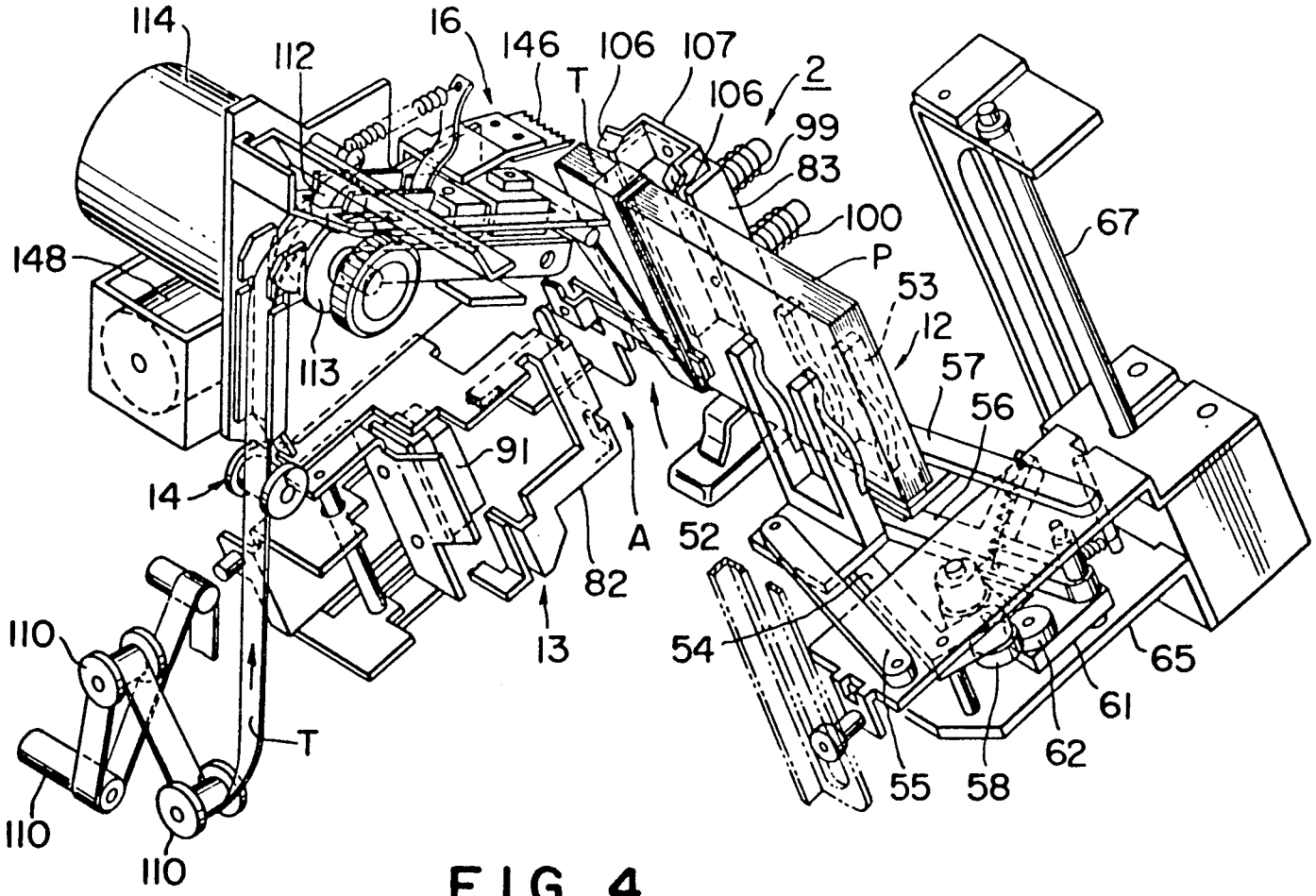
FIG. 4 is a perspective view of the embodiment indicated in FIG. 3.

As indicated in FIG. 3 and FIG. 4, the clamping means 13 has left and right clamping members 82,83 shaped like a letter C, when seen from above, and opposing each other. The left and right clamping members 82,83 are disposed on the left and right sides of the bundling position A, so that position where the banknotes P are held by the holding fingers 52,53 is maintained at a position close to the opposite end.

One of the clamping members 82 (the left clamping member in the diagram) is supported so that it is guided by guide shafts 84,85 provided on the machine frame 3 and freely advances towards and retreats from the bundling position A. The base end at the bottom of the machine frame 3 is linked, with play, by a long hole 88 and a pin 87 to the top end of a lever 86 that is pivotably supported. A cam follower 89, pivotably attached along the lever 86, receives an urging force of a spring and contacts the surface of a cam 90, so that the rotational motion of this cam causes the clamping member 82 to freely advance and retreat along the guide shafts 84,85.

In this embodiment, a stamp 91 is built into the clamping member 82, and the stamp 91 freely advances and retreats along guide shafts 92,93. The upper end of a lever 94, pivotably supported on the same shaft as the lever 86, is freely linked by a pin and a long hole. A cam follower 95 pivotably attached along the lever 94 receives the urging force of a spring and is brought into contact with the surface of another cam 96 on the same shaft. The shape of the cam 96 causes the stamp 91 to advance for a predetermined time as will be described later, and to perform a stamping operation.

The clamping member 83 on the other side (the right side in the diagram) is resiliently supported by springs 99,100 so that it can freely advance and retreat along guide shafts 97,98 provided on the machine frame 3 in the direction of the bundling position A. A base portion towards the bottom of the machine frame 3 is linked, with play, by a lever 101, a pin 102 and a long hole 103, so that a cam follower 104 pivotably attached along this lever 101 receives an urging force of a spring and is brought into contact with the surface of a cam 105. The shape of the cam 105 is such that the clamping member 83 advances slightly ahead of the clamping member 82, previously described.

Figure 10:
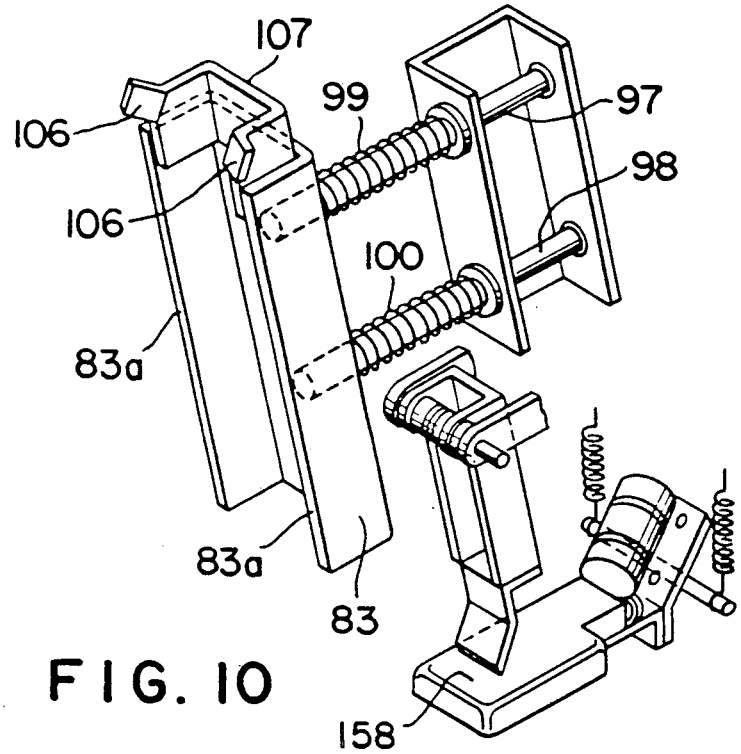
FIG. 10 is a perspective view of a thermal bonding pad mechanism portion and one clamping member of a clamping means.
Figure 11:
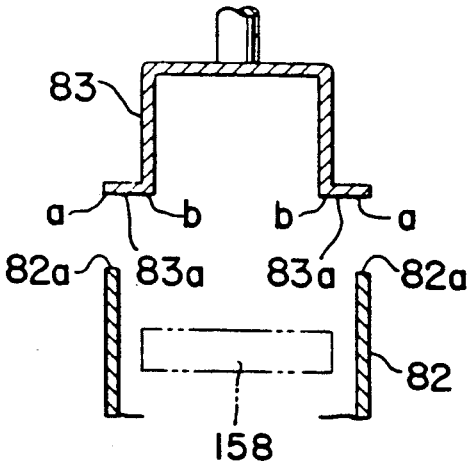
FIG. 11 is a horizontal section indicating the clamping member of the clamping means.
Figure 12:
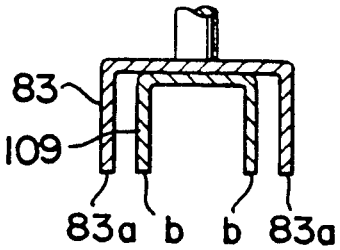
FIG. 12 is a horizontal section view indicating an alternative configuration of the clamping means.

At an upper portion of the C-shaped inner portion of the clamping member 83 are fixed tape guides 107 that have a C-shape when seen in plan. Guides 106,106 are provided at the left and right distal ends on the fixed tape guides 107 and open outwards as indicated in FIG. 10. The width of the inside portion is slightly wider than the width of a tape T. In addition, banknote contact edges 83*a*, 83*a* of the clamping member 83 have a width that extends in a lateral direction as indicated in FIG. 11, have portions a, a opposing contact edges 82*a*, 82*a* of the clamping member 82, and have positions b, b opposing both side portions of an element 108, which is to be described later. Accordingly, the portions a, b can be formed by bending the end of the clamping member 83 at right angles. However, as indicated in FIG. 12, a separate member 109 can be fixed to the inner side of the clamping member 82 and the opposing portions b, b thereof formed as the contact edges 83*a*, 83*a*.

As indicated in FIG. 3 and FIG. 4, the tape supply means 14 has a flat tape passage 111 to guide the tape T, led via intermediate reels 110,110,, from a tape reel (not indicated in the figure). A leading end of the passage 111 is open in the direction of the bundling position A, and 111 has upper and lower rollers 112, 113 that are tape supply rotating bodies at the trailing end of this passage. The roller 113 (or a belt) is rotatably driven by a pulse motor 114 so that it can be driven in the forward and reverse directions, so that the tape T is fed out by the necessary amount and so that if necessary, the motor can be reversed to apply a tension to the tape T. In the vicinity of the leading end of the tape passage 111 is provided a sensor $S_4$ to detect the leading end position of the tape T.

Figure 13:
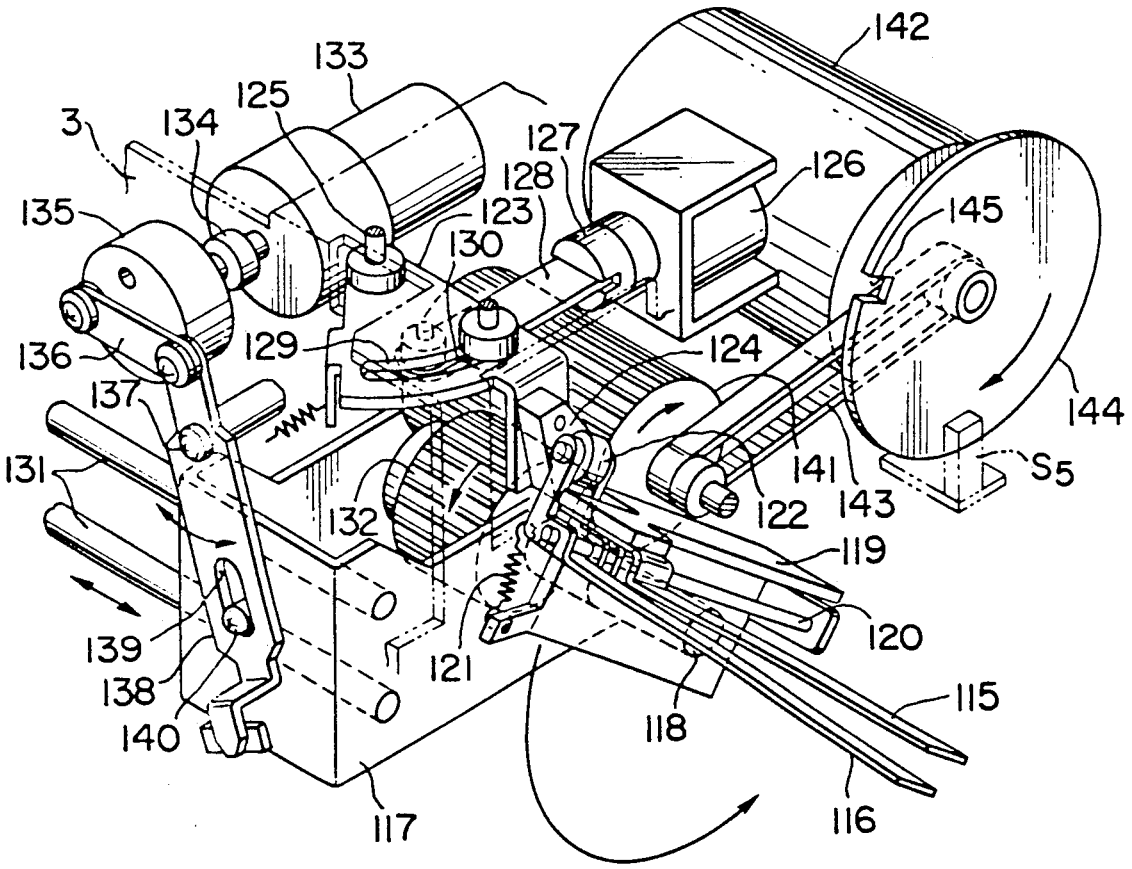
FIG. 13 is a perspective view of a tape winding means.

As indicated in FIG. 13, the tape winding means 15 has a movable holding member 116 and a fixed holding member 115 that holds the fed out end of the tape T. The holding members 115, 116 advance and retreat and swivel so as to describe an arc path indicated by the letter B in FIG. 3, at the bundling position A.

The fixed holding member 115 is provided fixed to the distal end of a swivel arm 119 supported so as to be freely rotatable by a shaft 118 relative to a moving frame 117. The movable holding member 116 has a structure that opens and closes with respect to the fixed holding member 115, being supported by a shaft 120 on the previously mentioned swivel arm 119 and having a spring 121 fitted between its base end and the swivel arm 119 to urge the distal ends of the holding members 115, 116 to close. In addition, the curved end of the base portion of the movable holding member 116 has a cam follower 122 pivotably attached to it, and the cam follower 122 is provided so as to be in free contact with a cam portion 124 of a cam member 123 provided on the side of the machine frame 3. When the cam follower 122 rides onto the cam member 124 (the status indicated in FIG. 13), the distal end of the movable holding member 116 is separated from the distal end of the fixed holding member 115.

The cam member 123 is rotatably supported inside its horizontal surface by a shaft 125 on the side of the machine frame 3. The cam member 123 is linked via a linkage lever 128 with a plunger 127 of a solenoid 126, so that when the plunger 127 is contracted, the cam member 124 is guided by a roller 130 on the side of the machine frame 3 which engages with a curved along hole 129. The cam member 124 is swivelled in the anti-clockwise direction around the center of the shaft 125.

The moving frame 117 that supports the holding members 115, 116 is supported so as to be freely advanced and retreated along guide shafts 131, 131 fixed to the machine frame 3. A gear 132 is pivotably attached to the moving frame 117, with the direction of motion of the moving frame 117 being the direction of the shaft.

A mechanism that retreats the moving frame 117 has one end of a lever 136 pivotably and eccentrically attached with respect to a member 135 fixed to a shaft 134 of a motor 133 mounted to the machine frame 3. The other end of the lever 136 is linked to the moving frame 117 by one end of a rocker arm 138 pivoted on a shaft 137. A long hole 139 on the other side of the rocker arm 138 engages with a pin 140 of the moving frame 117, so that the motor 133 advances and retreats the moving frame 117 by a predetermined stroke via the lever 136 and the rocker arm 138.

The gear 132 engages with a long gear 141 having elongated teeth and being pivotably supported on the side of the machine frame 3. The state of engagement of the gears 132, 141 is maintained even when the moving frame 117 is advanced or retreated. In addition, the gear 141 on the side of the machine frame 3 transmits the rotation of a motor 142 via a timing belt 143. Moreover, $S_5$ is a rotation detection sensor and 144 is a detection plate having a detection portion 145.

Figure 14:
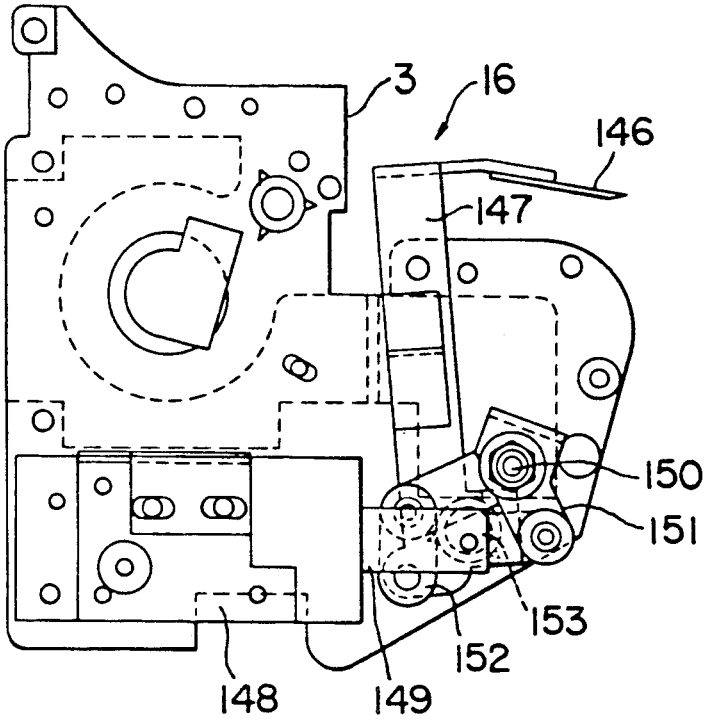
FIG. 14 is a side elevational view of a cutter mechanism.
Figure 15:
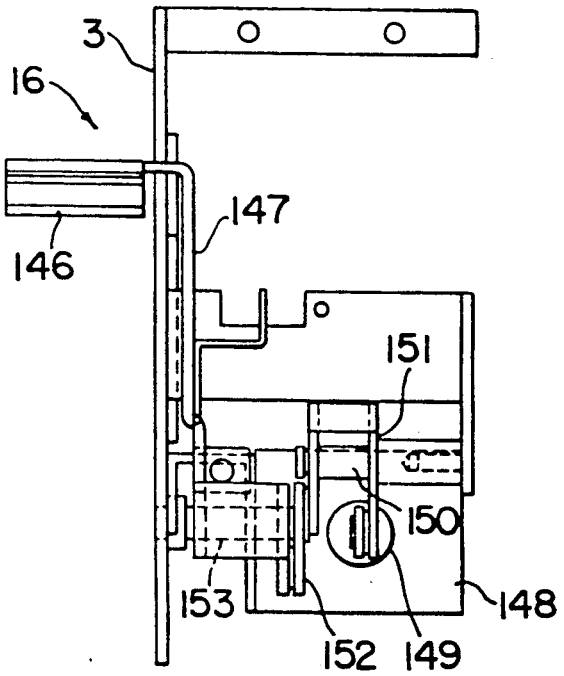
FIG. 15 is a front elevation of the cutter mechanism.

As shown in FIG. 14 and FIG. 15, the cutter mechanism 16 cuts the tape T by swiveling when a solenoid 148 moves a cutter arm 147 having a blade perpendicularly attached at its distal end downwards. A lever mechanism is provided between a plunger 149 and the cutter arm 147 so as to increase the swivel angle of a blade 146 with respect to the stroke of the plunger 149 of the solenoid 148. This lever mechanism links one end of a short lever 152 to one end of an L-shaped lever 151 pivoted at its bend by a shaft 150 on the machine frame 3, and the other end of the lever 152 is linked at a position close to a pivot shaft 153 of the cutter arm 147. When the plunger 149 is contracted, the L-shaped lever 151 rotates about the center of the pivot 150 in the clockwise direction, the short lever 152 is raised, and the cutter arm 147 rotates about the center of the pivot 153 and swivels a large distance in the clockwise direction indicated in the figure.

As shown in FIG. 3, the thermal bonding pad mechanism 17 has a lever 156 pivotably attached to the lower end of an arm 155. Arm 155 has one end pivoted by a shaft 154 to the machine frame 3, and is at a constant position with respect to the arm 155, drawn by a spring 157. The lever 156 has a thermal bonding pad mounted to it. Cam followers 159, 160, pivotably mounted along the arm 155, receive the urging force of the spring 157 and are successively brought into contact with a cam surface. The rotation of a cam 161 swivels a thermal bonding pad 158 in the direction of the bundling position A in the diagram to enter from the bottom into the clamping member 82 on the left side.

A separate pressing-down lever 162 is mounted to the shaft 154 of the arm 155 as a means to press the tape T, and a receiving portion 163 at its distal end contacts the lower end of the tape T that is wound around the banknotes P at the bundling position A, and is structured so that the tape T does not slacken.

The following is an explanation of the operation of the embodiment described above.

In FIG. 1 and FIG. 2, the banknotes P that are to be bundled are placed on the hopper 6 of the bundling machine 1, so that pressing the start button takes the banknotes one at a time into the inlet (not indicated in the diagram). The banknotes P that have been taken in are identified by the identification means 8 as to whether or not they are banknotes P suitable for bundling, and if they are suitable, are sent to the stacking portion Il via the conveyor path 9, and if they are banknotes P of differing denominations, counterfeit banknotes or doubly fed banknotes that are not suitable for bundling, then a signal from the identification portion 8 switches the separation fingers 10, and the unsuitable banknotes P are returned to the reject portion 7. The banknotes P that are sent to the stacking portion 11 are sent to the receiving portion 18 after having been taken in one at a time between the vanes 30,30,., of the vane wheels 26,26,., and are left on the bottom portion 24 where they are successively collated and aligned in an upright position. During this time, the round aligning rod 42 is intermittently driven by the long side alignment mechanism 32 so that it swivels and strikes one of the longitudinal ends of the banknotes P while the other of the longitudinal ends of the banknotes P is pressed against the fixed wall 3 so that the edges of the banknotes P are aligned. In addition, at the same time, the short-direction alignment mechanisms 43, 43 intermittently operate, and their alignment members 46, 46 swivel and press the upper edge of the banknotes P with the alignment portion 46*a* so that the edges of the banknotes P are aligned in the short direction.

Figure 16A:
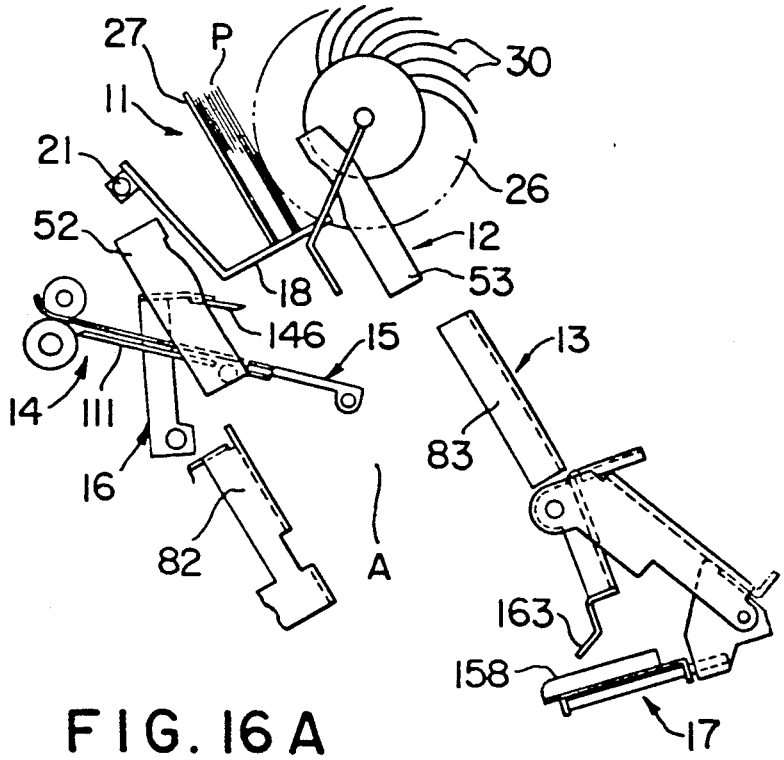
FIGS. 16 A through K are diagrams describing the operation of the bundling machine.

As indicated in FIG. 16A through FIG. 16K, when a predetermined number of banknotes P (customarily 100) are stacked in the aligned status in the stacking portion 11, the driving of the motor 68 of the holding and transfer means 12 causes the machine base 65 to rise because of the belt 73, and the left and right holding fingers 52, 53 rise in the open state and proceed to positions between the center and the short ends of the banknotes P in the stacking portion 11, where the holding fingers 52, 53 close by the rotation of the cams 59, 60 that are rotated by the motor 68, and hold the banknotes P between them (See FIG. 16A).

Figure 16B:
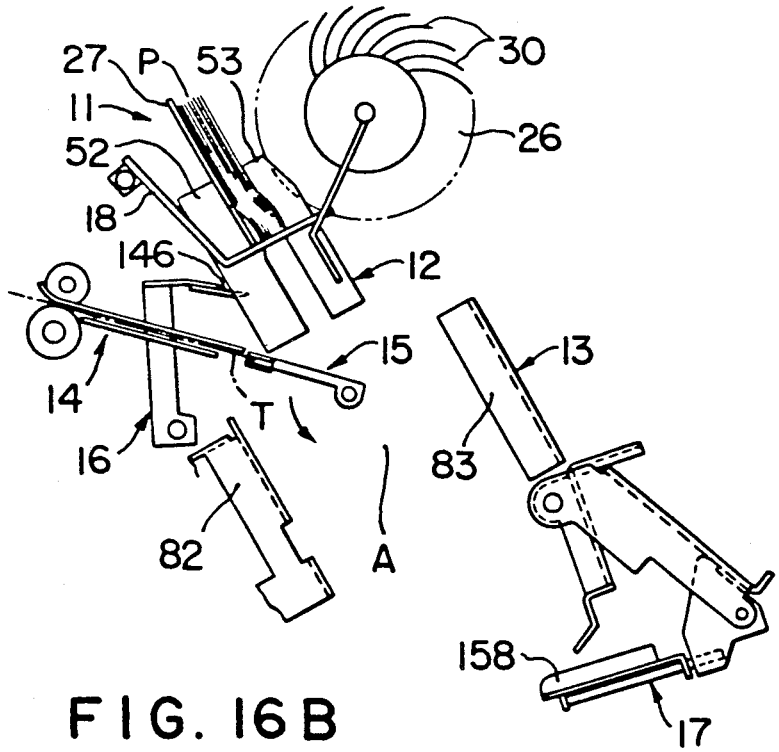
Figure 16C:
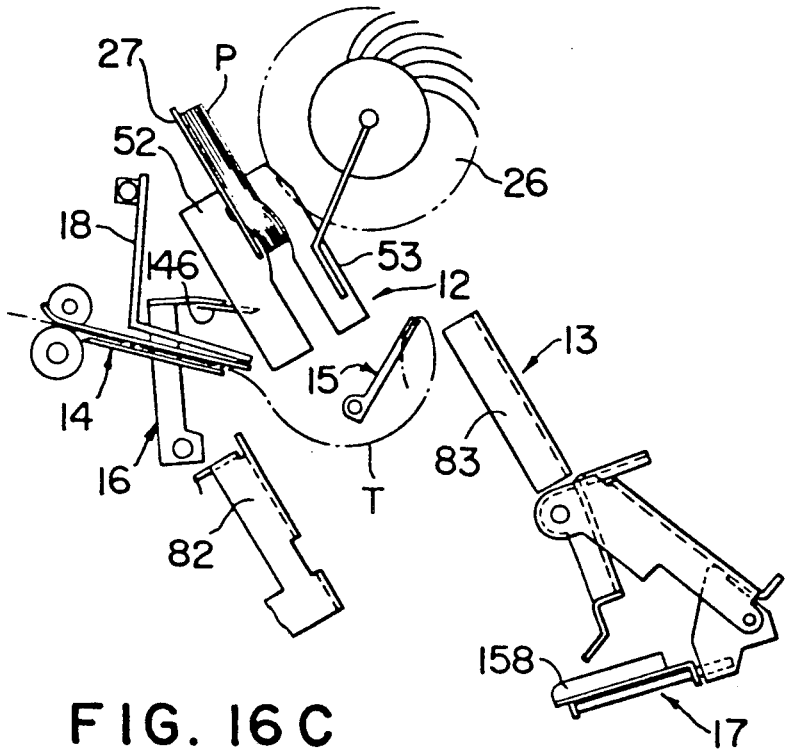
Figure 16D:
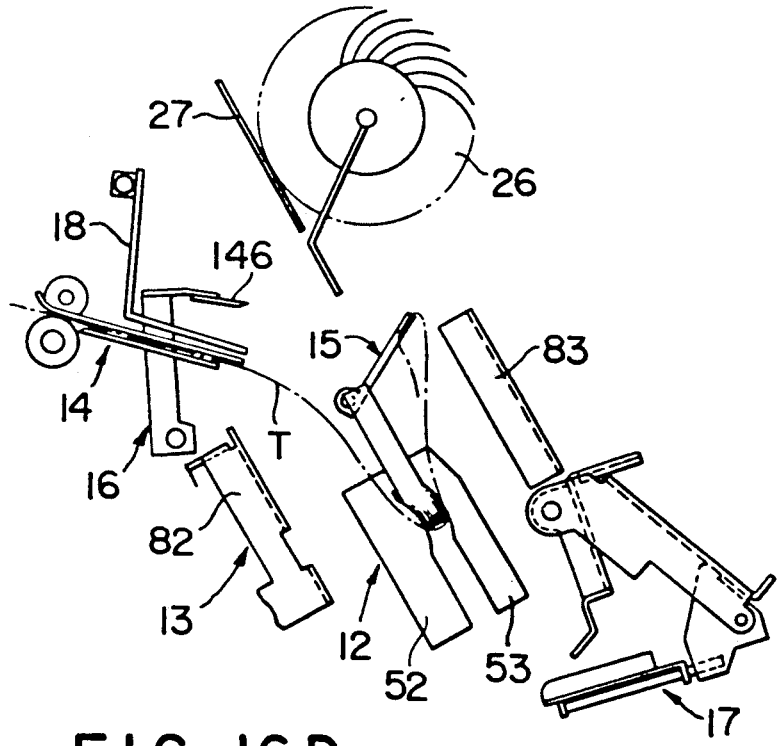
Figure 16E:
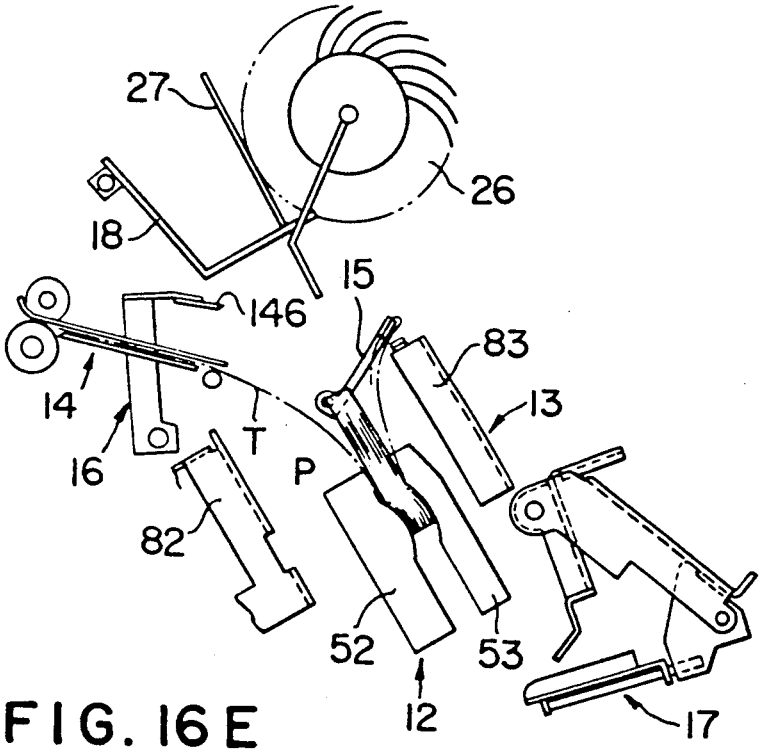
Figure 16F:
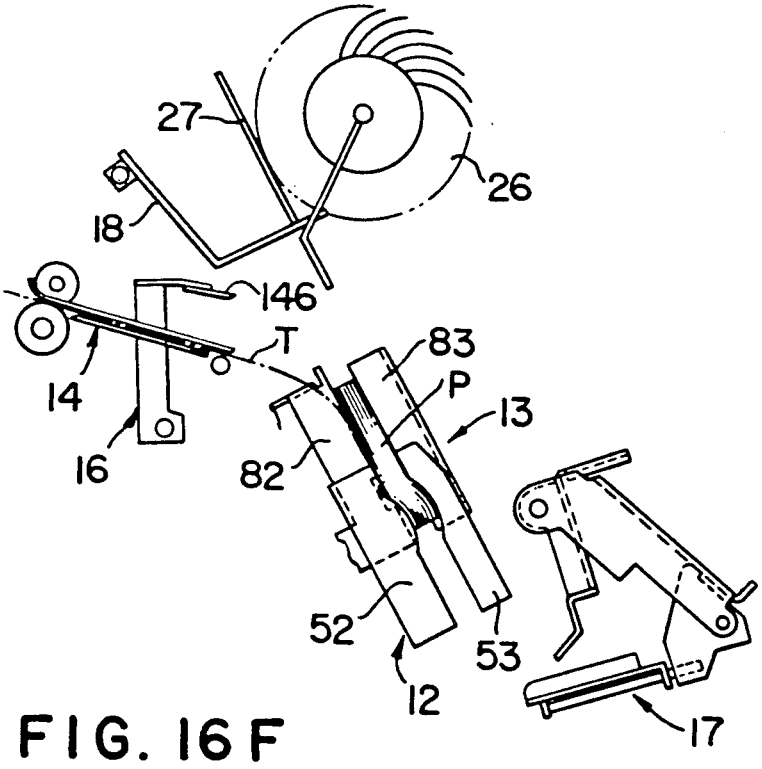
Figure 16G:
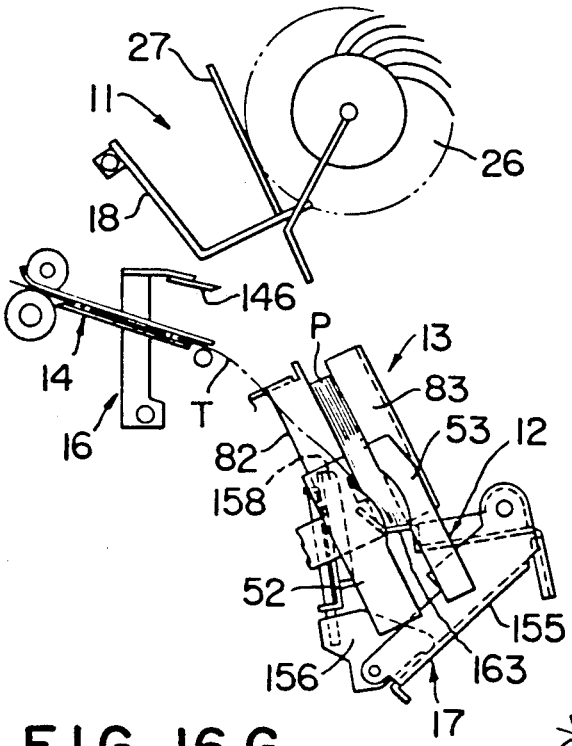
Figure 16H:
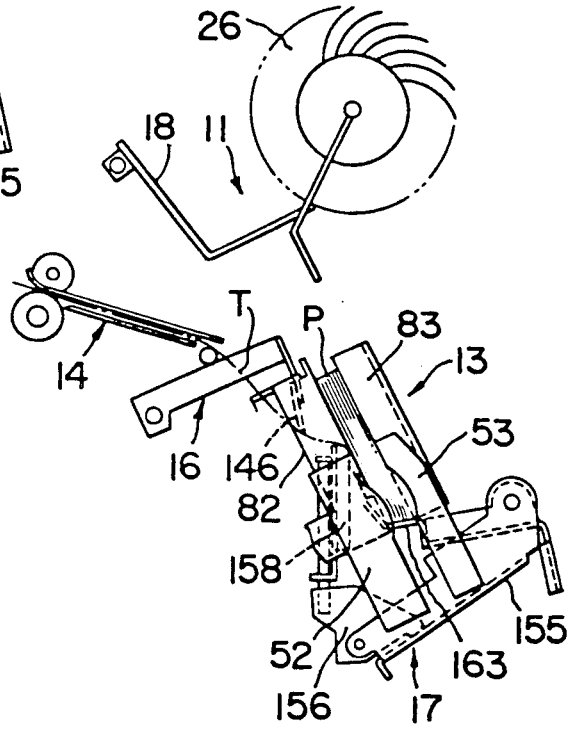
Figure 16I:
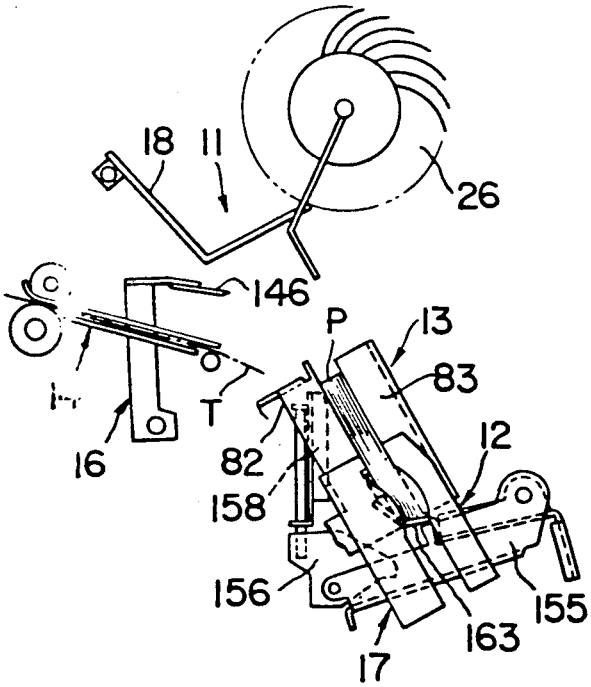
Figure 16J:
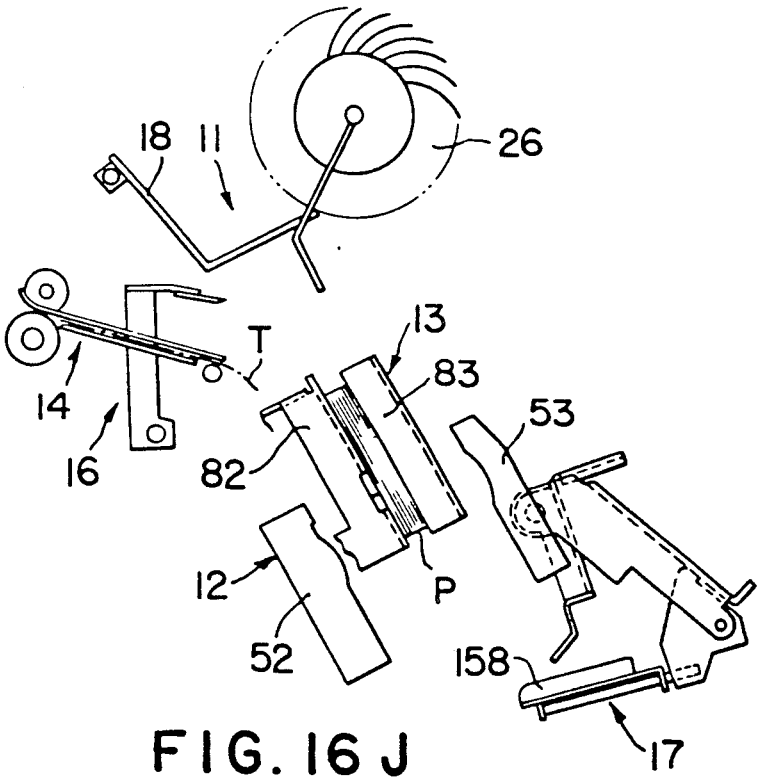
Figure 16K:
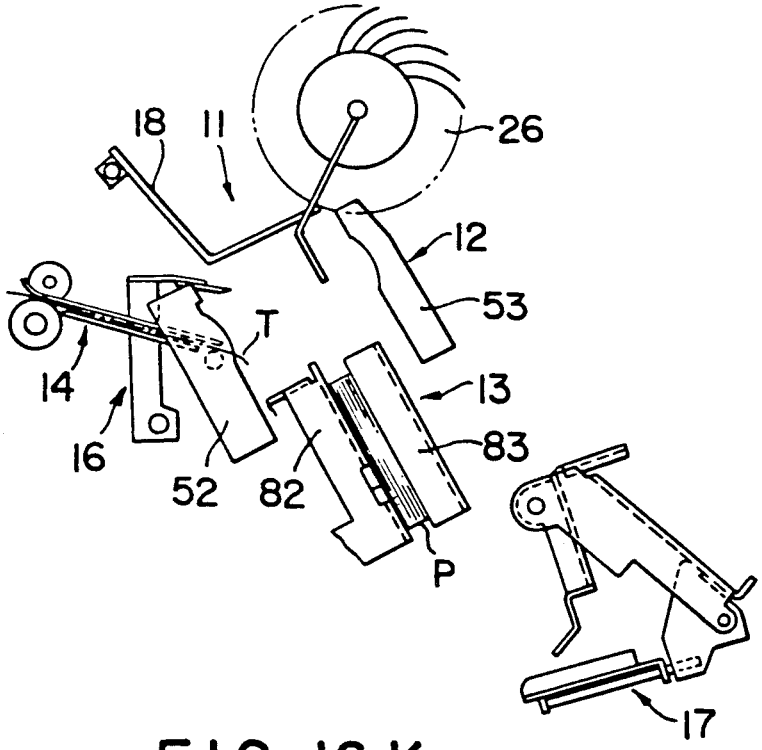

After the banknotes P have been held, the rotation of the cam 23 rocks the rocker lever 20 around the pivot 21 and in the clockwise direction as indicated in FIG. 16B, and the receiving portion 18 retreats from the lower portion of the banknotes P. At the same time, the motor 142 of the tape winding means 15 is driven and swivels the swivel arm 119 with the gears 141, 132, so that the cam follower 112 of the movable holding member 116 falls from the cam follower 124, the movable holding member 116 is closed by the urging force of spring 121, and the end of the tape T protruding from the distal end of the tape passage 111 is held between the distal ends of the fixed holding member 115 and the movable holding member 116. After this, the swivel arm 119 rotates further and stops once at the position as shown in FIG. 16C, which is approximately three quarters of the range of motion. By this, the tape T that has been drawn out is lowered, slackened and drawn at the bundling position A across the banknotes P. Then, the machine base 65 of the holding and transfer means 12 lowers once again, and the banknotes P are moved to the bundling position A (See FIG. 16D). The presser plate 27 of the stacking portion 11 advances, since it holds no banknotes P, and returns to the position where it is in contact with the outer surface of the vane wheels 26,26,,,.

Then, one of the clamping member 83, having a tape guide 107, of the clamping means 13 advances prior to the other (See FIG. 16E), and the tape T on the side of the end that is held by and drawn out from the tape winding means 15 is led to between the guides 106, 106 of the tape guide 107, and the position of the tape T controlled.

After this, the holding members 115, 116 rotate further, and wind the tape T around the banknotes P. But at this time, when the tape T passes the leading edge of the tape passage 111 of the tape supply means 14, that is, when the tape T passes a predetermined position shown in FIG. 16A, the cam follower 122 of the movable holding member 116 might ride up on the cam portion 124 and cancel the holding of the tape T, so when it passes a second time, the solenoid 126 is operated and the cam member 123 is drawn to release the cam portion 124. The cam follower 122 of the movable holding member 116 does not interfere with the cam portion 124 even when it rotates, and therefore allows the tape T to pass while being held. Then, the tape winding means 15 stops when the holding members 115, 116 have rotated more than once and have come to a position where the tape T is partially overlapped (See FIG. 16F). After this, the pulse motor 114 of the tape supply means 14 rotates in reverse for a predetermined time, and a tension is applied to the Tape T. When this occurs, when the friction between the tape surface and the roller 113 causes the tension of the tape T to reach a certain amount, the roller 113 slips, and so the tape T binds the banknotes P at a constant force. After this, the reversing of the pulse motor 114 by a predetermined number of pulses feeds out a constant amount of the tape T so that the binding force of the tape T is decreased slightly.

Then the cam 161 of the mechanism 17 rotates and the arm 155 is rotated about the center of the pivot 154, in the clockwise direction in the diagram. The receiving portion 163 of the bottom support lever 162 contacts and presses against the lower edge corner portion of the tape T that is wound around the banknotes P, and the thermal bonding pad 158 enters into the clamping member 82 and contacts the overlapping portion of the tape T that was wound first (See FIG. 16G), and starts the thermal bonding of the tape T.

After this, the motor 114 of the tape supply means 14 rotates in the forward direction for a predetermined number of pulses, and the tape T is slackened. The cutter mechanism 16 then operates and the cutter 146 contacts the tape T (See FIG. 16H) and performs cutting. After cutting, the thermal bonding pad 158 proceeds further and thermally bonds the cut ends of the tape T (See FIG. 16I).

After the tape has been cut, the motor 133 of the tape winding means 15 is driven and moving frame 117 is retreated via the lever 136 and the rocker arm 138 (to the left in FIG. 13), so that the gear 132 slides while it is still engaged with the gear 141 and draws back the shaft 118. The holding members 115, 116 are pulled back and from the bottom of the tape T that is wound around the banknotes P. After this, the stamp 91 advances and presses a predetermined seal on the surface of the tape T.

After the adhering of the tape T has been completed, the iron 158 returns (See FIG. 16J), and at the same time, the holding fingers 52, 53 of the holding and transfer means 12 separate and cancel the holding of the banknotes P. Then the clamping members 82, 83 of the clamping means 13 separate and release the bundled banknotes P in the downwards direction. All of the portions return from the states indicated from FIG. 16A through FIG. 16K, and the bundled banknotes P are collected inside an appropriate receiving box.

The description for the embodiment indicated in the figures has been given in terms of a bundling apparatus, but it is of course possible to apply the present invention for bundling other than leaf paper. The configuration of each of the portions is not necessarily limited to the embodiment indicated in the figures, but can be subjected to appropriate design changes. In addition, the period for which there is thermal bonding of the tape T can start either after the tape has been cut, or the thermal bonding can start before the tape has been cut with further thermal bonding performed to bond the cut ends of the tape after the tape has been cut. Furthermore, the period for which the holding is cancelled can end either before or after the clamping of the leaf paper is cancelled.

According to the first embodiment as has been described above, in the bundling position, there is a structure that winds tape around the leaf paper at a position where the leaf paper is not being held, and that also uses first and second clamping members in the vicinity of that winding position to compress and hold the leaf paper. A tension is applied to the tape in a state where the leaf paper is being held by the left and right contact edges of the first and second clamping members, so that the tape is cut and thermally bonded by a thermal bonding pads iron and without the necessity of winding the tape around the holder, as is the case for the conventional device. There is also the effect of being able to remove the bundled leaf paper by simply releasing the hold by the clamping members after bundling, and so there are no processes that damage the leaf paper, resulting in a neat bundle. In addition, each of the clamping members have left and right contact edges which compress and hold the leaf paper so that it is possible to tightly compress the leaf paper at the position where it is to be found and therefore achieve bundling without any slackening of the tape.

In addition, according to the second embodiment, the length of the contact edges of the clamping members is larger than the width of the leaf paper in the direction of winding the tape and the leaf paper is held in a state where the edge portions of the contact edges protrude past the leaf paper, and so in addition to the effect described above, there is the additional effect of preventing the ends of the paper from being bent and pulled down when the tap is wound around the leaf paper, so that there is no damage to the bundled leaf paper and a neat bundle is produced.

While the presently preferred embodiments of the present invention have been shown and disclosed, it is to be understood that this disclosure is for the purpose of illustration and that various changes and modifications may be made without departing from the scope of the invention as set forth in the appended claims.

We claim:

1. A leaf paper bundling apparatus for winding a tape around a periphery of a stack f leaf papers having long and short edges, comprising:

a stacking means for stacking a predetermined number of leaf papers in an upright position in a direction parallel to the short edges of the leaf papers and aligning both the long and short edges of the leaf papers;

a holding and transferring means for holding and transferring the stacked leaf papers in the upright position from said stacking means to a bundling position defined immediately below said stacking means, said holding and transferring means including left and right holding fingers for holding the stacked leaf papers and maintaining the upright position of the stacked leaf papers;

a clamping means having a pair of clamping members for clamping the stacked leaf papers from both sides thereof at a position on the stacked leaf papers separated from the one position whereat the leaf papers are held by said left and right holding fingers of said holding and transferring means;

a tape supply means for supplying tape to be wound around the stacked leaf papers, said tape supply means being provided adjacent one of said clamping members, and said tape supply means having tape tightening means for applying tension to the tape after the tape has been wound around the stacked leaf papers;

a tape winding means for winding the tape from said tape supply means around the periphery of the stacked leaf papers at a position on the stacked leaf papers other than the one position whereat the leaf papers are held by said left and right holding fingers of said holding and transferring means, said tape winding means including a fixed holding member and a movable holding member for holding an end of the tape supplied by said tape supply means and winding the tape by moving to advance, describe an arc path at said bundling position around the stacked leaf papers, release the tape and retreat from said bundling position in a direction parallel to the long edges of the leaf papers;

cutting means for cutting the tape after the tape has been wound around the stacked leaf papers by said tape winding means and tension has been applied to the tape by said tape tightening means, said cutting means being provided adjacent said tape supply means; and a tape thermal bonding means for adhering the cut ends of the tape together, said tape thermal bonding means including a thermal bonding pad moving to the cut ends from a predetermined position and retreating to said predetermined position after thermal bonding has been carried out.

2. The leaf paper bundling apparatus according to claim 1, wherein each said clamping member has a pair of contact edges having a length dimension greater than the width of the leaf paper in the direction in which the tape is wound around the stacked leaf papers.

3. The leaf paper bundling apparatus according to claim 1, wherein said stacking means comprises a first alignment mechanism for aligning the long edges of the leaf papers and two second alignment mechanisms for aligning the short edges of the leaf papers.

4. The leaf paper bundling apparatus of claim 3, wherein said stacking means further comprises a receiving portion for receiving and supporting the leaf papers in the upright position, said first alignment mechanism is disposed adjacent said receiving portion and has an aligning rod for intermittently contacting the short edges of the leaf papers, and said second alignment mechanisms are disposed above said receiving portion at opposite ends thereof and have alignment portions for intermittently contacting the long edges of the stacked leaf papers.

5. The leaf paper bundling apparatus according to claim 1, wherein one said holding finger of said holding and transferring means has a protrusion thereon and the other said holding finger has a corresponding recess for bending the stacked leaf papers while being held in the upright position, and wherein said holding and transferring means mounts said holding fingers for movement towards and away from each other to hold and release the stacked leaf papers and for movement between said stacking means and said bundling position.

6. The leaf paper bundling apparatus according to claim 1, wherein said clamping means reciprocably mounts said clamping members opposite each other for reciprocal movement between a position clamping the stacked leaf papers and a position not clamping the stacked leaf papers.

7. The leaf apparatus bundling apparatus of claim 6, wherein each said clamping member comprises a pair of spaced apart contact edges for clamping the stacked leaf paper bundle with each said pair of spaced apart contact edges straddling the tape wound around the stacked leaf paper on opposite sides of the stacked leaf paper.

8. The leaf paper bundling apparatus of claim 7, wherein one said clamping member comprises tape guides for guiding the tape between said contact edges.

9. The leaf paper bundling apparatus of claim 7, wherein said tape thermal bonding means pivotably mounts said thermal bonding pad for pivotal movement between said predetermined position and a position between said contact edges of one of said clamping members whereat the cut ends of the tape are located.

10. The leaf paper bundling apparatus according to claim 1, wherein said tape winding means comprises a cam mechanism for moving said movable holding member to release the tape and a solenoid for preventing said cam mechanism from releasing the tape.

11. A leaf paper bundling apparatus for winding a tape around a periphery of a stack of leaf papers having long and short edges, comprising:

a stacking device for stacking a predetermined number of leaf papers;

a holding and transferring device for holding and transferring the stacked leaf papers in the upright position from said stacking device to a bundling position defined below said stacking device;

a pair of clamping members for clamping the stacked leaf papers therebetween at said bundling position, wherein each said clamping member has a pair of spaced apart contact edges having a length dimension greater than the width of the leaf paper in the direction in which the tape is wound around the stacked leaf papers for clamping the stacked leaf paper bundle, with each said pair of spaced apart contact edges straddling the tape wound around the stacked leaf paper on opposite sides of the stacked leaf paper;

a tape supply means for supplying tape to be wound around the stacked leaf papers, said tape supply means being provided adjacent one of said clamping members, and said tape supply means having tape tightening means for applying tension to the tape after the tape has been wound around the stacked leaf papers;

a tape winding means for winding the tape from said tape supply means around the periphery of the stacked leaf papers;

cutting means for cutting the tape after the tape has been wound around the stacked leaf papers by said tape winding means and tension has been applied to the tape by said tape tightening means, said cutting means being provided adjacent said tape supply means; and a tape thermal bonding means for adhering the cut ends of the tape together.

12. The leaf paper bundling apparatus of claim 11, wherein one said clamping member comprises tape guides for guiding the tape between said contact edges.

13. The leaf paper bundling apparatus of claim 11, wherein said tape thermal bonding means pivotably mounts a thermal bonding pad for pivotal movement between a predetermined position and a position between said contact edges of one of said clamping members whereat the cut ends of the tape are located.

* * * * *